United States Patent [19]

Lepetit et al.

[11] 4,292,144

[45] Sep. 29, 1981

[54] PROCESS AND DEVICE FOR COATING SMALL-SIZED ELEMENTS WITH A METAL DEPOSIT

[75] Inventors: Pierre J. Lepetit, Saint-Vrain; Emile J. Genieys, Paris, both of France

[73] Assignee: Office National d'Etudes et de Recherches Aerospatiales, France

[21] Appl. No.: 163,326

[22] Filed: Jun. 26, 1980

[30] Foreign Application Priority Data

Jun. 29, 1979 [FR] France ..... 79 17046

[51] Int. Cl.[3] ..... C25D 5/08; C25D 17/16

[52] U.S. Cl. ..... 204/23; 204/223

[58] Field of Search ..... 204/23, 20, 222, 223

[56] References Cited

U.S. PATENT DOCUMENTS

| | | | |
|---|---|---|---|
| 3,577,324 | 5/1971 | Patterson | 204/23 |
| 3,994,785 | 11/1976 | Rippere | 204/23 |
| 3,994,796 | 11/1976 | Mayer | 204/223 |
| 4,019,968 | 4/1977 | Spaziante | 204/23 |

FOREIGN PATENT DOCUMENTS

| | | | |
|---|---|---|---|
| 1203645 | 8/1970 | United Kingdom | 204/23 |
| 1387444 | 3/1975 | United Kingdom | 204/20 |
| 176774 | 1/1966 | U.S.S.R. | 204/23 |

*Primary Examiner*—T. M. Tufariello

*Attorney, Agent, or Firm*—Ostrolenk, Faber, Gerb & Soffen

[57] ABSTRACT

The invention relates to depositing a metal on small-sized objects by electrolytic means. The objects are maintained in suspension in an electrolyte containing the metal to be deposited and which flows in a closed circuit while passing between two electrodes which are alternately anode and cathode, the anode being protected by a mobile screen able to assume two positions. The temperature of the electrolyte and the concentration of ions of said metal therein are maintained constant.

9 Claims, 1 Drawing Figure

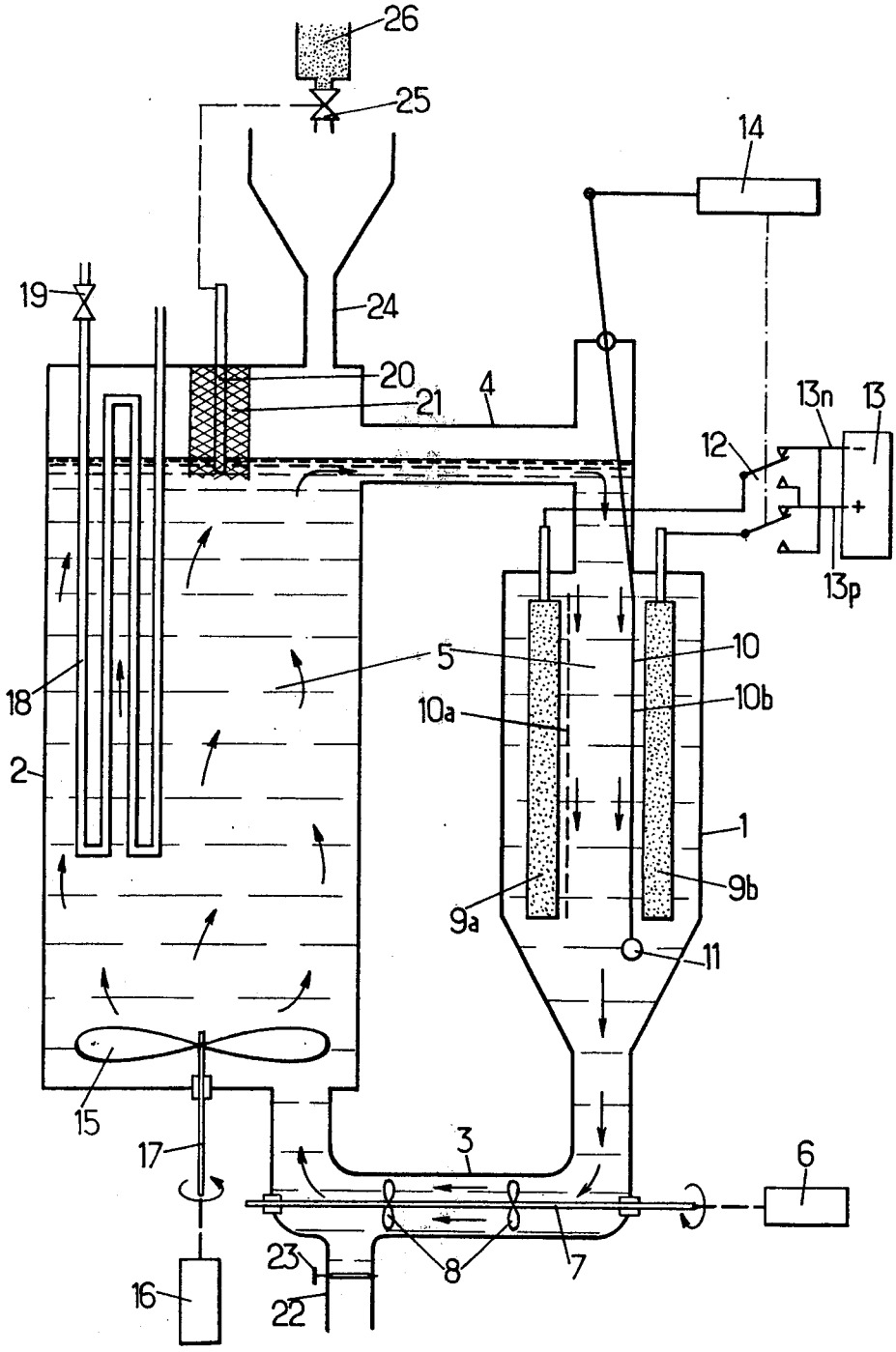
26
25
14
19
24
20
21
4
13n
13
12
13p
5
10
10a
10b
18
2
1
9b
9a
11
15
17
3
6
23
8
7
16
22

PROCESS AND DEVICE FOR COATING SMALL-SIZED ELEMENTS WITH A METAL DEPOSIT

The invention relates to the coating of small-sized elements, particularly fibres or flakes, made from carbon for example, with a metal deposit, especially nickel.

The applicant described, in his French Pat. No. 2,058,732 filed on Sept. 23, 1969 and the first certificate of addition No. 2,285,475 filed on Sept. 17, 1974, a device formed from a drum whose axis slopes with respect to the vertical and comprising an anode and a cathode in an electrolyte bath, with a rake for putting into motion the carbon fibres to be coated with nickel.

This device, which gives excellent results, has however the disadvantage of limited dimensions because the fibres have a very large surface to be coated per kilogramme and because it is difficult to cool a large-sized fixed electrolyte bath to compensate for the heating due to the electrolysis conditions which provide the nickel deposit. The result is then a limitation in the capacity of production of fibres coated by the device.

There is known moreover (French patent application No. 2,352,077 filed on May 17, 1976 by ELECTROPLATING ENGINEERS OF JAPAN LIMITED) a device for nickel-plating parts comprising a depositing unit in which the workpiece to be coated is maintained in position, a storage reservoir and two pipes connecting said unit and said reservoir so as to form a flow loop for the electrolyte between the unit and the reservoir; the device comprises furthermore means for maintaining the active metal (nickel) content of the electrolyte constant by means of a pH-meter which measures the pH of the electrolyte in the reservoir and causes the addition of metal ions (nickel ions) to the bath to compensate for the metal deposited. In this device, only the electrolyte flows in a closed circuit.

The present invention relates to a process for coating small-sized elements with a metal coating by electrolysis from an electrolyte, whose temperature and ion content of the metal to be deposited are maintained substantially constant and in which the polarity of the electrodes is periodically reversed, characterized in that it consists in maintaining these elements in suspension in the electrolyte, in causing the electrolyte with the elements in suspension to flow in a closed loop while causing it to pass between two electrodes and is disposing a protecting screen in the vicinity of the positive maintained electrode.

The invention also related to a device for coating small-sized elements with a metal coating by electrolysis from an electrolyte containing ions of the metal to be deposited, this device comprising an electrolysis tank, two electrodes, means for making alternatively positive or negative one of the electrodes with respect to the other and means for maintaining substantially constant the temperature and the content in ions of the metal to be deposited of the electrolyte, characterized in that the electrolysis tank is connected to a storage tank by means of two pipes enabling a closed circuit with the tanks to be formed, in that means are provided for causing the electrolyte to flow containing, in suspension, the small-sized elements to be coated, and in that it comprises means for disposing a protecting screen in the vicinity of the positive maintained electrode.

Advantageously, the device comprises control means which simultaneously move said screen and switch the electric supply to the electrodes to make positive the electrode in front of which said screen is brought with respect to the other electrode.

The invention will in any case be well understood with the help of the complement of description which follows, as well as with the accompanying drawing, in which the single FIGURE represents schematically and in section an installation for electrolytically depositing a metal coating, especially of nickel, on small-sized elements, such as fibres or flakes, made from an electrically-conducting material, for example carbon.

To construct such an installation, the following or similar is the way to set about it.

The installation comprises essentially an electrolysis tank 1, a storage tank 2 for the electrolyte and the elements to be coated or covered and two pipes 3 and 4 connecting these two tanks and allowing closed-circuit flow in the direction of the arrows of the electrolyte with said elements in suspension.

The electrolyte 5 is formed, for example, essentially from an aqueous solution of nickel sulphate containing also boric acid and hydrochloric acid.

Electrolyte 5 with the elements to be coated or covered fills substantially the whole of tanks 1 and 2, the whole of the lower pipe 3 (connecting the lower parts of tanks 1 and 2) and a part of the upper pipe 4 (connecting the upper parts of tanks 1 and 2). The closed-circuit flow of electrolyte 5 is provided by a motor 6 which rotates a shaft 7 disposed in the axis of the lower pipe 3 and provided with blades 8.

The electrolysis tank 1 contains two insoluble electrodes **9*a* and 9*b*, made for example from graphite, and a mobile screen 10 which may occupy two positions 10*a* and 10*b*; this screen made, for example, from polytetrafluoroethylene cloth is held vertical by a ballast weight 11. Each electrode 9*a*, 9*b* plays alternately the role of anode and cathode. To this end, a double switch 12 is provided which, in its first state (i.e. the one shown in the case illustrated of an electromechanical switch), connects electrode 9*a* to the negative terminal 13*n* of an electric DC source 13 and electrode 9*b* to the positive terminal 13*p* of this source and, in its second state, connects electrode 9*a* to the positive terminal 13*p* and electrode 9*b* to the negative terminal 13*n*. A control member 14 accomplishes simultaneously reversal of the state of double switch 12 and the movement from one position to another of mobile screen 10, so that this screen is in front of the electrode 9*a* or 9*b* which is switched to the positive terminal 13*p***, i.e. in front of the electrode which plays the role of anode. A timing device (or possibly a manual control) enables this switching to be effected at regular intervals, for example every thirty minutes.

The storage tank 2 contains:

a stirrer 15 rotated by a motor 16 which drives the shaft 17 of the stirrer;

a coil of tubing 18 in which there flows, when valve 19 is open, a fluid for cooling the bath of electrolyte contained in tank 2 and thereby the whole of the mass of moving electrolyte 5; and an element 20 able to determine the pH of the electrolyte 5 in tank 2, this element 20 being electrically protected by a Faraday cage 21.

The installation which has just been described comprises further:

a discharge 22 disposed at the lower part of pipe 3 and which enables the elements coated (with nickel) to be extracted with the electrolyte by opening the cock or valve 23; and a feed 24 for adding to the electrolyte 5 in tank 2, nickel ions for replacing the nickel ions deposited, in the electrolyte tank 1, on the elements to be coated; device 20, 21 which determines the pH of the electrolyte may control the opening of valve 25 of a reservoir 26 containing a nickel salt (advantageously nickel carbonate) when device 20, 21 has established that the pH has reached a predetermined threshold.

In one preferred embodiment:

the tank of electrolyte 1 is made from polypropylene and has the following dimensions: 300 mm×200 mm, with a height of 500 mm;

the electrodes 9*a* and 9*b* are formed from three parallelepipedic bars (450 mm×50 mm×50 mm) made from graphite, spaced 130 mm apart;

screen 10 is made from polytetrafluoroethylene cloth;

tank 2 is made from heat-insulated polypropylene; it is cylindrical (diameter 450 mm, height 1030 mm);

the heat exchanger or coil of tubing 18 is formed from eight tubes 30 mm in diameter, connected end to end and made from polypropylene;

pipes 3 and 4 are made from polypropylene and have a sectional diameter of 100 mm;

the temperature of the electrolyte in tank 2 is maintained at 60° C. by the tubing coil 18;

control member 14 actuates switch 12 and moves screen 10 every thirty minutes;

the electrolyte is formed from 300 liters of permuted water, 110 kg of nickel sulphate NiSO4.7 $H_2O$, 11 kg of boric acid $H_3BO_3$ and 1 liter of hydrochloric acid;

nickel carbonate is introduced every fifty seconds (through the opening of valve 25) in a quantity depending on the pH of electrolyte 5 in tank 2; in a variation, a given amount of nickel carbonate may be introduced when the pH of the electrolyte exceeds 3.8;

the elements to be coated are carbon fibres of the type designated in French Pat. No. 2,058,732 filed on Sept. 23, 1969 by the applicant by the expression "conducting carbon skeleton".

The coating of these fibres with nickel takes place in the installation which has just been described as follows.

The carbonaceous fibres are maintained in suspension in the electrolyte by means of circulating blade 8 and stirrer 15.

Screen 10 is in front of the anode; for example screen 10 is in position 10*b* and switch 12 in the position shown in the drawing. Under these conditions, electrode 9*b* is the anode protected by screen 10 and electrode 9*a* is the cathode. The tubing coil 18 maintains the temperature at approximately 60° C. by cooling the electrolyte which tends to heat up under the effect of the electrolysis which takes place in tank 1, the carbonaceous fibres which pass between anode 9*b* and cathode 9*a* being coated with nickel deposited electrolytically. The result is nickel impoverishment of the electrolyte. System 20, 21, 24, 25, 26 maintains the desired amount of nickel ions in the electrolyte.

After a certain period of time, of the order of a few minutes to several hours, for example thirty minutes, member 14 moves screen 10 which is brought into the position 10*a* and causes switch 12 to change over, which reverses the polarity of the electrodes, electrode 9*a* becoming the anode protected by screen 10 and electrode 9*b* becoming the cathode. The operation for coating the fibres passing between electrodes 9*a* and 9*b* continues; furthermore, the metal nickel which was deposited on electrode 9*a* during the preceding phase (during which this electrode was the cathode) is almost completely redissolved in the electrolyte because this electrode 9*a* is now the anode (which is a soluble electrode as long as it is covered with metal nickel).

Then, after a further period of a few minutes to a few hours, for example thirty minutes, member 14 causes movement of screen 10 towards position 10*a* and return of switch 12 to its first state (that shown in the drawing); a new cycle begins, the nickel deposited on electrode 10*b* (while it was the cathode) being redissolved in the electrolyte 5 of tank 1 for this electrode 10*b* is now the anode (anode soluble at the beginning).

The invention presents a large number of advantages, particularly the following.

A large number of fibres or flakes may be treated at one and the same time, for there is no limitation insofar as the size of the tanks is concerned.

The reversal of polarity of the electrodes enables a nickel efficiency very close to 100% to be obtained.

Maintaining the workpieces to be treated in suspension prevents their caking together and consequently enables coatings to be obtained of a greater thickness than with prior process and devices.

Thus, in the case of treating carbon fibres in accordance with the patent and the addition already cited, we end up with the formation of tubular metal fibres having a much greater wall thickness.

Finally, coated fibres are obtained, of an excellent quality, with a nickel efficiency close to 100% and in large batches at each operation.

So that the invention may be better understood, examples of application will be given hereafter, the treatment having been carried out in the installation which has been described with reference to the single FIGURE.

EXAMPLE 1—Manufacture of nickel flock

There is fed into the installation at 24:

300 liters of deionized water, 11 kg of boric acid, 110 kg of nickel sulphate $NiSO_4.7H_2O$ 1 liter of technical hydrochloric acid, 1 kg of carbon flock obtained by pyrolysis, in nitrogen, of carded cotton and having been subjected to a pyrolytic carbon deposit in saturated xylene nitrogen so as to obtain the required electrical conductivity (see above-mentioned U.S. Pat. No. 2,057,732).

Blades 8 and shaft 7 were operated. Deionized water was added to the contents of tank 2 so that the level in the upper pipe 4 was 5 cm at the outlet of tank 2. The flow of liquid was then set at 1.6 liters/per second, which corresponds to an average flow speed of 4 cm per second in the electrolysis tank 1. Electrodes 9*a*, 9*b* were connected to the 15-volt DC source 13 and the teflon cloth screen 10 was placed in front of the anode. The weave of the cloth of the teflon screen prevented the smallest particles in suspension from passing into the bath.

The intensity of the current was then 150 A. When the temperature reached 60° C., valve 19 was opened supplying exchanger 18 so as to remove the surplus heat.

Every thirty minutes, the polarity of electrodes 9*a*, 9*b* was reversed, as well as the position of screen 10, so as to protect the new anode. This latter, which had previously been a cathode and had become coated with nickel, was gradually freed of it, the metal returning in solution into the bath. The nickel yield thus reached 100%.

During the operation, care was taken to maintain the following constant:

the level in tank 2 by adding deionized water;

the temperature of the bath at 60° C. by adjusting the flow of cooling water;

the pH of the electrolyte solution at 3.8 by periodic automatic addition of nickel carbonate by means of the feed regulating pump 25, 26 whose operation was controlled by the pH-meter 20.

After about a hundred hours of operation, the electric supply was cut off, the tank was emptied by actuating valve 23.

The nickel-coated carbon fibres were collected on a screen. They were washed and the few agglomerates which had possibly formed were removed by sedimentation; they were oven-dried and 7.5 kg of flock was obtained comprising 85% nickel and 15% carbon (C/N=0.17).

This raw material may be used for manufacturing nickel felts, as described in the above-mentioned U.S. Pat. No. 2,058,732, or for any other application, for forming catalyser walls, for example.

The average flow speed of the electrolyte and of the particles in suspension may be advantageously modulated during the nickel-depositing operation; for example it may be slow at the beginning, then become more rapid depending on a chosen programme.

EXAMPLE 2—Manufacture of nickel flock

The same procedure was carried out as in example 1, but the operation was stopped after two-hundred hours. There were then obtained, all other conditions being equal, fibres with a C/Ni ratio=0.07.

It will be noted that the same result may be obtained in the case of example 1 by increasing the supply current to the electrodes providing the efficiency of the heat exchanger 18 is adjusted accordingly.

It will also be noted that the flow rate of the particles in front of the electrodes is equal to the flow rate of the electrolyte increased by the sedimentation rate. It follows that the fibres less charged with nickel travel more slowly and so are in contact with the cathode for a longer period of time. This is a factor favourable to the homogeneity of the deposit.

EXAMPLE 3—Manufacture of cobalt flock

The same procedure was carried out as in example 1, but the nickel sulphate was replaced by cobalt sulphate $CoSO_4,7H_2O$.

EXAMPLE 4—Manufacture of copper flock

The same procedure was carried out as in example 1, but there was fed into tank 2:

300 liters of deionized water, 75 kg of copper sulphate $CuSO_4.5H_2O$ 30 kg of sulphuric acid $SO_4H_2$ at 66° Baume. $H_2SO_4$ The flow rate of the water-cooling circuit of exchanger 18 is adjusted so that the temperature of the bath does not exceed 25° C.

It is preferable, because of the very low pH (less than 1) to compensate for the loss of copper from the bath by periodic addition of copper carbonate at the rate of 2.3 g per ampere-hour. About 8 kg of flock were obtained comprising 85% Cu and 15% C.

EXAMPLE 5—Graphite-flake copper plating

The same procedure was carried out as in example 4, but the carbon flock was replaced by 5 kg of graphite flakes of a diameter of about 500 microns and a thickness of 10 to 20 microns.

After thirty hours operation, 7.5 kg of copper-plated flakes were obtained comprising 33.3% Cu and 66.7% graphite.

The product obtained may be advantageously used for manufacturing, by hot compression, electric generator brushes.

As is evident and as it follows moreover from what has gone before, the invention is in not limited to those of its modes of appication and embodiments which have been more specially considered; it embraces, on the contrary, all variations thereof.

We claim:

1. A process for coating small-sized elements with a metallic coat by electrolysis from an electrolyte, the temperature and the ion content of the metal to be deposited of which are maintained substantially constant and in which the polarity of the electrodes is periodically reversed, characterized in that it comprises maintaining these elements in suspension in the electrolyte, causing the electrolyte with the elements in suspension to flow in a closed loop and to pass between two electrodes, disposing a protecting screen in the vicinity of the positive maintained electrode and periodically moving the protecting screen from the vicinity of the positive maintained electrode to the vicinity of the negative maintained electrode and reversing the flow of current such that the negative maintained electrode becomes the positive maintained electrode.

2. The process as claimed in claim 1, characterized in that the metal to be deposited is nickel.

3. The process as claimed in claim 1, characterized in that the periodic moving of the protective screen and reversal of current flow are effected simultaneously.

4. The process as claimed in claim 3, characterized in that movement of the protecting screen causes the reversal of current flow.

5. The process as claimed in claim 4, characterized in that the electrolyte comprises nickel carbonate or nickel sulfate.

6. The process as claimed in claim 4, characterized in that the metal to be deposited is cobalt or copper.

7. A device for coating by the process of claim 1, small-sized elements with a metal coat by electrolysis from an electrolyte containing ions of the metal to be deposited, this device comprising an electrolysis tank, two electrodes, means for causing one of the electrodes to be alternately positive or negative with respect to the other and means for maintaining substantially constant the temperature of the electrolyte and its ion content of the metal to be deposited, characterized in that the electrolysis tank is connected to a storage tank by two pipes allowing a closed circuit with these tanks to be formed, in that means are provided for causing the electrolyte to flow containing, in suspension, the small-sized elements to be coated and in that it comprises a protecting screen and means for periodically moving said protecting screen so that it is disposed in the vicinity of the positive maintained electrode.

8. The device as claimed in claim 7, characterized in that it comprises control means which simultaneously move said screen and switch the electric supply to the electrodes so as to make the electrode, in front of which said screen is brought, positive with respect to the other electrode.

9. The device as claimed in claim 7 or 8, characterized in that the metal to be deposited is nickel.

* * * * *